US010237650B2

(12) United States Patent
Mucha et al.

(10) Patent No.: US 10,237,650 B2
(45) Date of Patent: Mar. 19, 2019

(54) SENSOR COMPONENT WITH ENHANCED ACOUSTIC OVERLOAD POINT AND ELECTROSTATIC DISCHARGE PROTECTION

(71) Applicant: INVENSENSE, INC., San Jose, CA (US)

(72) Inventors: Igor Mucha, Bratislava (SK); Marek Matej, Bratislava (SK); Peter Pracny, Bratislava (SK)

(73) Assignee: INVENSENSE, INC., San Jose, CA (US)

( * ) Notice: Subject to any disclaimer, the term of this patent is extended or adjusted under 35 U.S.C. 154(b) by 0 days.

(21) Appl. No.: 15/614,527

(22) Filed: Jun. 5, 2017

(65) Prior Publication Data

US 2018/0352330 A1 Dec. 6, 2018

(51) Int. Cl.
*H04R 3/02* (2006.01)

(52) U.S. Cl.
CPC ..... *H04R 3/02* (2013.01); *H04R 2201/003* (2013.01); *H04R 2410/03* (2013.01)

(58) Field of Classification Search
CPC . H04R 3/02; H04R 2201/003; H04R 2410/03
USPC ..... 381/95, 109, 111, 113, 174
See application file for complete search history.

(56) References Cited

U.S. PATENT DOCUMENTS

2008/0089536 A1 4/2008 Joseffson
2011/0057291 A1* 3/2011 Slupsky ..... G08C 17/04 257/531
2014/0086433 A1 3/2014 Joseffson
2015/0318833 A1* 11/2015 Nielsen ..... H04R 3/06 381/107
2017/0307668 A1* 10/2017 Buffa ..... G01R 27/2605
2017/0318385 A1* 11/2017 Harney ..... H02M 3/07
2018/0027338 A1* 1/2018 Shajaan ..... H04R 19/04

* cited by examiner

*Primary Examiner* — Vivian Chin
*Assistant Examiner* — Friedrich W Fahnert
(74) *Attorney, Agent, or Firm* — Amin, Turocy & Watson, LLP

(57) ABSTRACT

A feedback signal is employed to facilitate enhancing an acoustic overload point and electrostatic discharge protection of a sensor component and associated circuit. The sensor component comprises a backplate component and a diaphragm component. The backplate component is biased to a low-level voltage associated with a ground. The diaphragm component is biased to a defined high-voltage associated with a charge pump. The diaphragm component generates a signal based on movement of the diaphragm component in relation to the backplate component in response to the input signal. A feedback component receives the signal from the diaphragm component and generates an inverted signal based on the signal. The inverted signal or a processed inverted signal, which can be derived from a filter component that filters the inverted signal, is transmitted to the backplate component.

20 Claims, 9 Drawing Sheets

SENSOR COMPONENT WITH ENHANCED ACOUSTIC OVERLOAD POINT AND ELECTROSTATIC DISCHARGE PROTECTION

TECHNICAL FIELD

The subject disclosure relates generally to sensor technology, e.g., a sensor component with an enhanced acoustic overload point and electrostatic discharge protection.

BACKGROUND

Typically, to facilitate operation of a microphone, the backplate of a silicon microphone, such as a MicroElectro-Mechanical Systems (MEMS) microphone, can be biased to a high direct current (DC) voltage by an on-chip charge pump, with a certain voltage (e.g., 12 volts), and the diaphragm of the microphone can be biased to ground or to a voltage level that is relatively close to ground using a relatively high impedance to allow the diaphragm to generate an electrical signal. Microphones can be subject to certain issues, such as acoustic overload or electrostatic discharge, which can negatively impact operation of a microphone. For example, when the sound port of a silicon microphone is exposed to electrostatic discharge, the diaphragm of the microphone may be torn or moved away from its normal position by an electrostatic force that can be caused by the diaphragm and backplate being charged with charges of the same polarity, which can cause the diaphragm and backplate to repel from each other. This can cause damage to the microphone and/or negatively impact performance of the microphone.

The above-described description is merely intended to provide a contextual overview relating to sensor technology, and is not intended to be exhaustive.

SUMMARY

The following presents a simplified summary of various aspects of the disclosed subject matter in order to provide a basic understanding of some aspects described herein. This summary is not an extensive overview of the disclosed subject matter. It is intended to neither identify key or critical elements of the disclosed subject matter nor delineate the scope of such aspects. Its sole purpose is to present some concepts of the disclosed subject matter in a simplified form as a prelude to the more detailed description that is presented later.

One or more embodiments, such as one or more devices, systems, methods, integrated circuits, and techniques disclosed herein, relate to employing feedback circuitry to facilitate enhancing an acoustic overload point of a sensor component and/or an associated circuit (e.g., application-specific integrated circuit (ASIC)), while also facilitating mitigating electrostatic discharge associated with the sensor component and/or the associated circuit. Disclosed herein is a system comprising a sensor component that senses an input signal, wherein the sensor component comprises a backplate component, and a diaphragm component that generates a signal based at least in part on movement of the diaphragm component in relation to the backplate component in response to the input signal, wherein the backplate component is biased to a defined low-level voltage associated with a ground. The system also comprises a feedback component that receives the signal from the diaphragm component and generates an inverted signal based at least in part on the signal, wherein the feedback component provides the inverted signal as an output, and wherein the inverted signal or a processed inverted signal that is based at least in part on the inverted signal is transmitted to the backplate component.

Further disclosed herein is a method comprising generating a signal as a function of movement of a first plate component in relation to a second plate component in response to an input signal, wherein the second plate component is biased to a defined low voltage level associated with a ground. The method also comprises supplying the inverted signal or a processed inverted signal that is based at least in part on the inverted signal to the second plate component.

The following description and the annexed drawings set forth in detail certain illustrative aspects of the disclosed subject matter. These aspects are indicative, however, of but a few of the various ways in which the principles of the disclosed subject matter may be employed, and the disclosed subject matter is intended to include all such aspects and their equivalents. Other advantages and distinctive features of the disclosed subject matter will become apparent from the following detailed description of the disclosed subject matter when considered in conjunction with the drawings.

DETAILED DESCRIPTION

Figure 1:
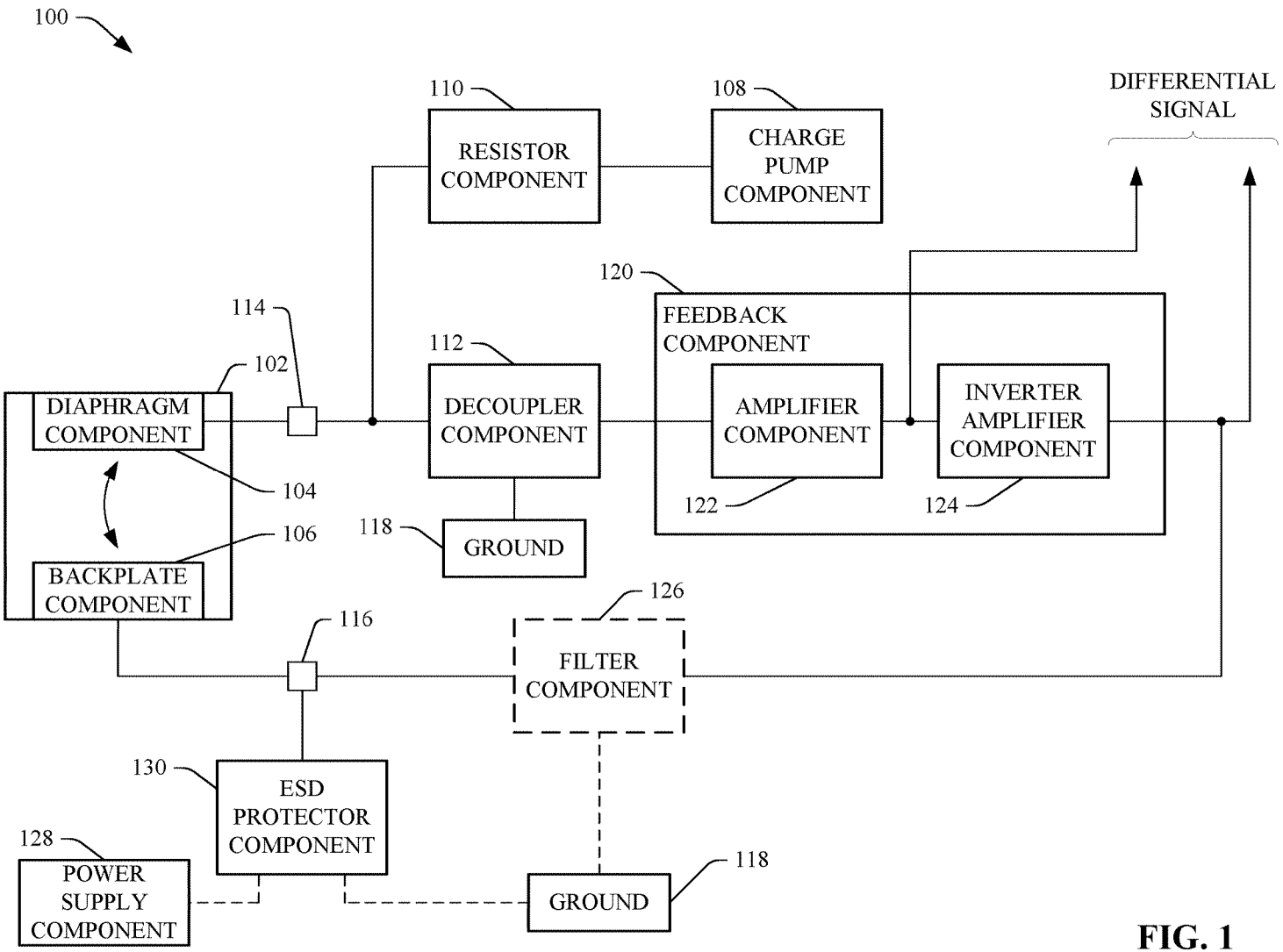
FIG. 1 illustrates a block diagram of an example system that can enhance the acoustic overload point and electrostatic discharge protection associated with a sensor component and interface circuitry, in accordance with various aspects and embodiments of the disclosed subject matter.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

With regard to some conventional microphones, to facilitate operation of a microphone, the backplate of a silicon microphone, such as a MicroElectroMechanical Systems (MEMS) microphone, can be biased to a high direct current (DC) voltage by an on-chip charge pump, with a certain voltage (e.g., 12 volts), and the diaphragm of the microphone can be biased to ground or to a voltage level that is relatively close to ground using a relatively high impedance to allow the diaphragm to generate an electrical signal. Microphones can be subject to certain issues, such as an undesirable acoustic overload or electrostatic discharge, either of which can negatively impact operation of a microphone. For example, when the sound port of a silicon microphone is exposed to electrostatic discharge, the diaphragm of the microphone may be torn or moved away from its normal position by an electrostatic force that can be caused by the diaphragm and backplate being charged with charges of the same polarity, which can cause the diaphragm and backplate to repel from each other. This can cause damage to the microphone and/or negatively impact performance of the microphone.

Figure 7:
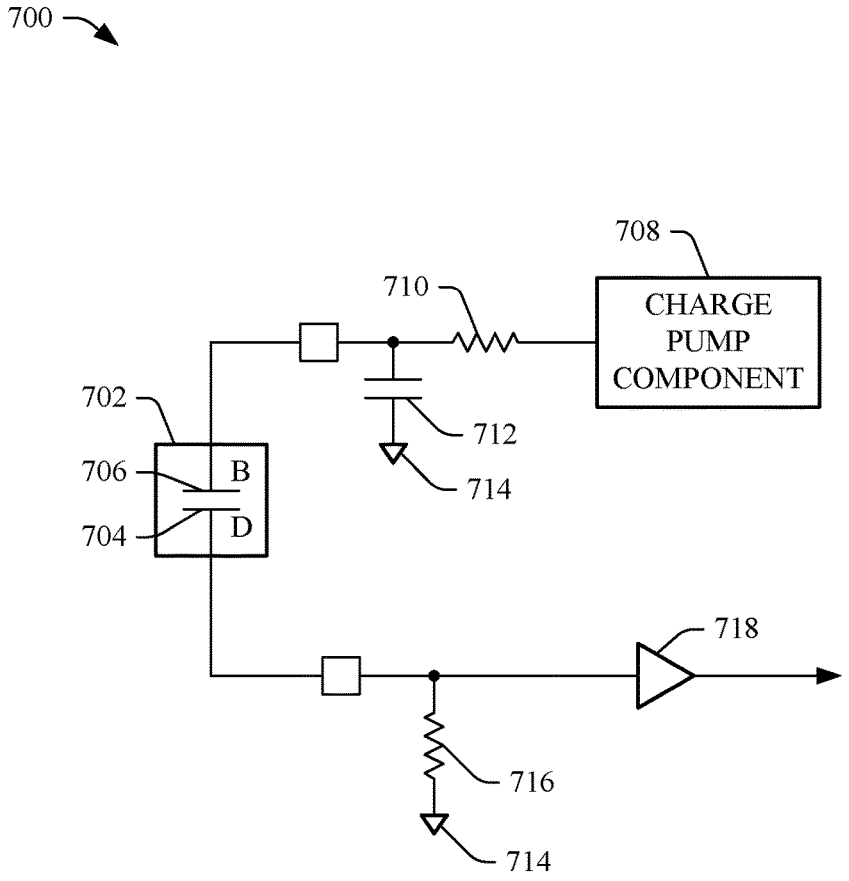
FIG. 7 depicts a diagram of an example microphone circuit that can be employed to facilitate interfacing a microphone element, in accordance with an embodiment.

Turning briefly to FIG. 7, FIG. 7 depicts a diagram of an example microphone circuit 700 that can be employed to facilitate interfacing a microphone element, in accordance with an embodiment. The microphone circuit 700 can be part of a microphone. The microphone circuit 700 can comprise a microphone element 702 that can facilitate generating an electric signal in response to sensing an audio signal (e.g., voice or other sounds). The microphone element 702 can comprise a diaphragm component 704 (D) and a backplate component 706 (B) that can be configured to form a variable capacitor. The microphone element 702 can be, for example, a MEMS microphone element.

To facilitate operation of the microphone element 702, the microphone circuit 700 also can comprise a charge pump component 708 that can be associated with the backplate component 706 and can supply a desired high voltage level (e.g., 12 volts or higher) to bias the backplate component 706 to a desired voltage (e.g., a desired high voltage level). The microphone circuit 700 can include a low-pass filter, which can be formed using a resistor component 710 and a capacitor component 712, wherein the resistor component 710 can be connected to the charge pump component 708 on one end and the backplate component 706 and the capacitor component 712 on the other end of the resistor component 710. The other end of the capacitor component 712 can be connected to the ground 714. The resistance value of the resistor component 710 can be, for example, on the order of 1 gigaohm (e.g., ranging from approximately 1 gigaohm to 10 gigaohms). The capacitor component 712 can comprise a decoupling capacitor, which can have a capacitance value of, for example, 50 picofarads (pF) to 80 pF, or another desired capacitance value. The decoupling capacitor can facilitate creating an alternating current (AC) ground for the backplate component 706 of the microphone element 702.

The diaphragm component 704 can be biased to ground 714 (e.g., biased to a desired low voltage level associated with the ground 714) through a resistor component 716 that can be connected to the diaphragm component 704 on one end and the ground 714 on the other end. The resistor component 716 can have a desirably high resistance value, such as, for example, a resistance value on the order of teraohms or tenths of teraohms. In some implementations, the resistor component 716 can be formed using anti-parallel diodes.

To facilitate forming the variable capacitor of the microphone element 702, the diaphragm component 704 can comprise a flexible plate that can move or vibrate in response to an audio signal received via an audio port of the microphone. As the diaphragm component 704 moves in response to the audio signal, it also can be moving in relation to the backplate component 706, which can vary the capacitance of the variable capacitor, and which can result in the diaphragm component 704 generating a signal (e.g., electrical signal) that can be based at least in part on (e.g., can correspond to) the audio signal. The capacitance level of the variable capacitor can be in the range of, for example, 1 pF to 2 pF, or another desired capacitance level.

The microphone circuit 700 also can comprise an amplifier component 718 that can be associated with the diaphragm component 704, wherein the amplifier component 718 (e.g., a unity gain amplifier) can act as a buffer and can have a gain of one or approximately one. The signal generated by the diaphragm component 704 can be provided to the input port of the amplifier component 718, wherein the amplifier component 718 can provide a buffered signal as an output. The application-specific integrated circuit (ASIC) (e.g., charge pump, filter, input buffer with its gate biasing resistance) of the microphone circuit 700 that is associated (e.g., interfaced) with the microphone element 702 can facilitate interfacing the microphone element 702 and the associated ASIC with, for example, other components, such as an analog-to-digital (A-to-D) converter, a gain component, another filter, another ASIC that can perform such signal conditioning and processing (e.g., A-to-D conversion, an amplification stage, filtering), or other post-processing circuitry.

One drawback of the interface of the microphone circuit 700 can be that it does not provide for a desirable acoustic overload point. Another drawback of the interface of the microphone circuit 700 can be that the diaphragm component 704 and backplate component 706 of the microphone element 702 can remain unprotected against electrostatic discharge (ESD) or other events when the audio port of the microphone is exposed to electrostatic discharge, in part, because the backplate component 706 is connected to a relatively high bias voltage (e.g., 12 volts or higher) and the diaphragm component 704 carries the signal generated by a relatively low capacitive source (e.g., the microphone element 702), which typically can be in the range of 1 pF to 2 pF. As a result, any additional capacitive loading can unnecessarily load the microphone element 702 and decrease its sensitivity and signal-to-noise ratio (SNR).

Figure 8:
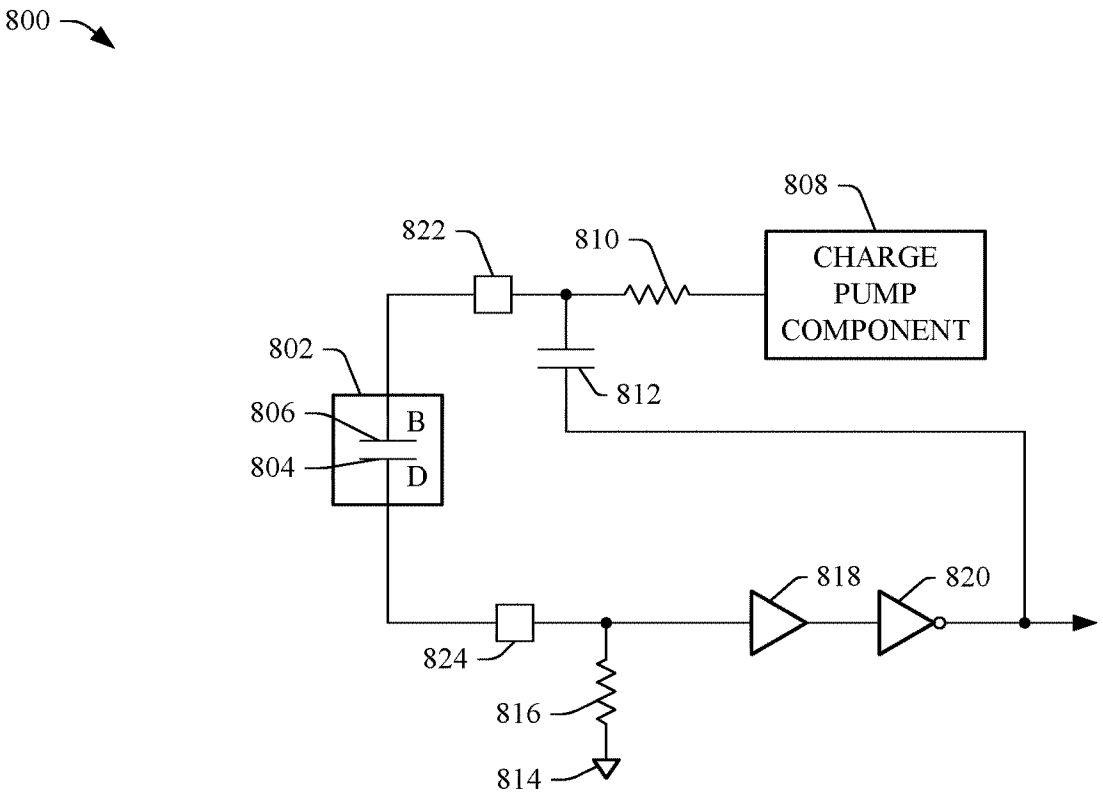
FIG. 8 illustrates a diagram of an example microphone circuit that can employ a feedback loop, in accordance with an embodiment.

Referring to FIG. 8, FIG. 8 illustrates a diagram of an example microphone circuit 800 that can employ a feedback loop, in accordance with an embodiment. The microphone circuit 800 can be part of a microphone. The microphone circuit 800 can comprise a microphone element 802 that can facilitate generating an electric signal in response to sensing an audio signal (e.g., voice or other sounds). The microphone element 802 can comprise a diaphragm component 804 (D) and a backplate component 806 (B) that can be configured to form a variable capacitor. The microphone element 802 can be, for example, a MEMS microphone element.

The microphone circuit 800 also can include a charge pump component 808 that can be associated with the backplate component 806 and can supply a desired high voltage level (e.g., 12 volts or more) to bias the backplate component 806 to a desired voltage (e.g., a desired high voltage level). The microphone circuit 800 can comprise a low-pass filter, which can be formed using a resistor component 810 and a capacitor component 812, wherein the resistor component 810 can be connected to the charge pump component 808 on one end and the backplate component 806 and the capacitor component 812 on the other end of the resistor component 810. The capacitor component 812 can be part of the feedback loop. The capacitor component 812 can be a coupling capacitor that can be bypassing the feedback signal to the backplate component 806.

The diaphragm component 804 can be biased to ground 814 (e.g., biased to a desired low voltage level associated with the ground 814) through a resistor component 816 that can be connected to the diaphragm component 804 on one end and the ground 814 on the other end. The resistor component 816 can have a desirably high resistance value. In some implementations, the resistor component 816 can be formed using anti-parallel diodes.

To facilitate forming the variable capacitor of the microphone element 802, the diaphragm component 804 can comprise a flexible plate that can move or vibrate in response to an audio signal received via an audio port of the microphone. As the diaphragm component 804 moves in response to the audio signal, it also can be moving in relation to the backplate component 806, which can vary the capacitance of the variable capacitor, and which can result in the diaphragm component 804 generating a signal that can be based at least in part on the audio signal.

The microphone circuit 800 also can comprise an amplifier component 818 and an inverter amplifier component 820. The amplifier component 818 can be associated with the diaphragm component 804, wherein the amplifier component 818 (e.g., a unity gain amplifier) can act as a buffer and can have a gain of one or approximately one. The output port of the amplifier component 818 can be connected to the input port of the inverter amplifier component 820. The signal generated by the diaphragm component 804 can be provided to the input port of the amplifier component 818, wherein the amplifier component 818 can provide a buffered signal as an output. The buffered signal can be provided to the input port of the inverter amplifier component 820. The inverter amplifier component 820 can have a gain of one (or approximately one), or a gain of greater than one, if gain is desired. The inverter amplifier component 820 can generate an inverted signal, based at least in part on the signal, and can provide the inverted signal as an output. The inverted signal at the output of the inverter amplifier component 820 can be provided to the backplate component 806 through the capacitor component 812.

The circuitry (e.g., ASIC) of the microphone circuit 800 that is associated (e.g., interfaced) with the microphone element 802 can facilitate interfacing the microphone element 802 with other components, such as, for example, an A-to-D converter, a gain component, another filter, another ASIC that can perform same or similar signal conditioning and processing (e.g., A-to-D conversion, an amplification stage, filtering), or other post-processing circuitry.

Similar to the microphone circuit 700, a drawback of the interface of the microphone circuit 800 of FIG. 8 can be that the diaphragm component 804 and backplate component 806 of the microphone element 802 can remain unprotected against electrostatic discharge or other events when the audio port of the microphone is exposed to electrostatic discharge, because the backplate component 806 is connected to a relatively high bias voltage and the diaphragm component 804 carries the signal generated by a relatively low capacitive source (e.g., the microphone element 802). Thus, any additional capacitive loading can unnecessarily load the microphone element 802 and undesirably decrease its sensitivity and SNR.

Figure 9:
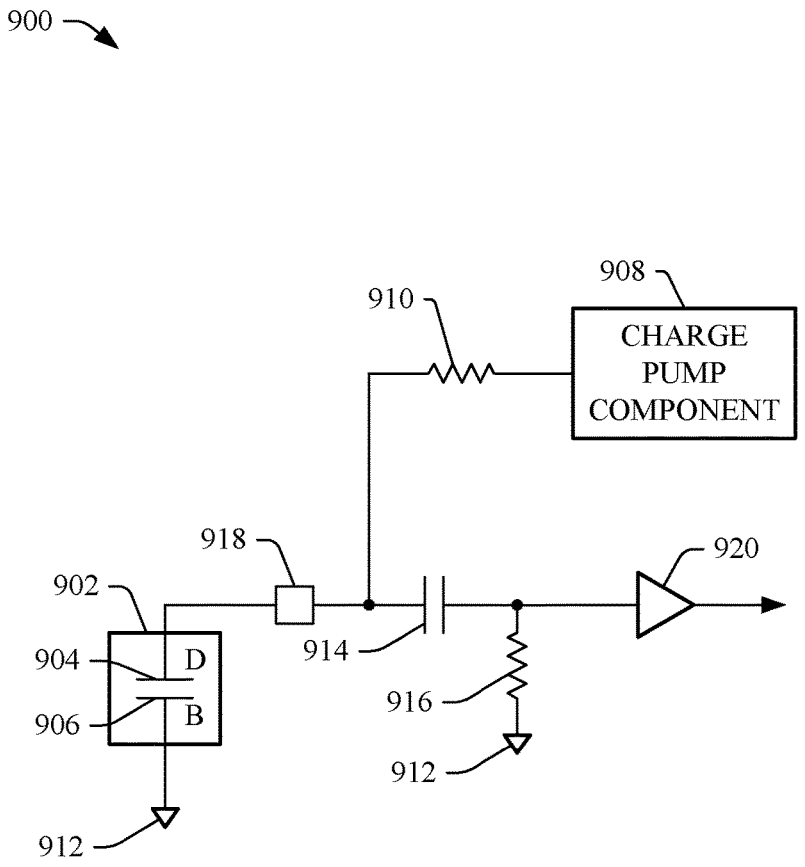
FIG. 9 presents a diagram of another example microphone circuit that can be employed to facilitate interfacing a microphone element, in accordance with an embodiment.

Turning to FIG. 9, FIG. 9 presents a diagram of another example microphone circuit 900 that can be employed to facilitate interfacing a microphone element, in accordance with an embodiment. The microphone circuit 900 can be part of a microphone. The microphone circuit 900 can comprise a microphone element 902 that can facilitate generating an electric signal in response to sensing an audio signal (e.g., voice or other sounds). The microphone element 902 can comprise a diaphragm component 904 (D) and a backplate component 906 (B) that can be configured to form a variable capacitor. The microphone element 902 can be, for example, a MEMS microphone element.

To facilitate operation of the microphone element 902, the microphone circuit 900 also can comprise a charge pump component 908 that can be associated with the diaphragm component 904 and can supply a desired high voltage level (e.g., 12 volts or higher) to bias the diaphragm component 904 to a desired voltage (e.g., a desired high voltage level) through the resistor component 910, which can have a desirably high resistance value (e.g., on the order of gigaohms). The backplate component 906 can be biased to ground 912 (e.g., can be biased to a desired low voltage level associated with the ground 912).

The microphone circuit 900 also can include a capacitor component 914 and a resistor component 916, wherein one end of the capacitor component 914 can be associated with node 918, and associated with the charge pump component 908 and the diaphragm component 904. The other end of the capacitor component 914 can be associated with the input port of amplifier component 920 and with the resistor component 916, which can be connected to the ground 912. The capacitor component 914 can be a decoupling capacitor that can have desired capacitance and can decouple the DC level (e.g., 12 volts) at the node 918 from the ground 912. The decoupling capacitor can be employed because it can be desirable for the input port of the amplifier component 920 to be biased to or close to a ground voltage level. The amplifier component 920 (e.g., a unity gain amplifier) can act as a buffer and can have a gain of one or approximately one.

To facilitate forming the variable capacitor of the microphone element 902, the diaphragm component 904 can comprise a flexible plate that can move or vibrate in response to an audio signal received via an audio port of the microphone. In response to the audio signal, the diaphragm component 904 can move or vibrate in relation to the backplate component 906, which can vary the capacitance of the variable capacitor, and which can result in the diaphragm component 904 generating a signal that can based at least in part on (e.g., can correspond to) the audio signal. The signal can be fed through the capacitor component 914 to the input port of the amplifier component 920. The signal can enter, for example, an ASIC through the decoupling capacitance of the capacitor component 914. The interface of the microphone circuit 900 can be preferred in some instances, such as, for example, when it is desirable for the signal from the microphone element 902 to be inverted without using an inverter amplifier on the ASIC.

The interface of the microphone circuit 900 can allow for the use of electrostatic discharge protection circuitry to provide electrostatic discharge protection of the backplate component 906 of the microphone element 902. However, the interface of the microphone circuit 900 does not provide for a desirable acoustic overload point, as the acoustic overload point will be the same as or similar to the acoustic overload point of the microphone circuit 700 of FIG. 7.

To overcome issues of other systems, methods, and techniques are presented that can facilitate enhancing an acoustic overload point of a circuit (e.g., ASIC) associated with a sensor component while at the same time enabling and enhancing electrostatic discharge protection of the sensor component and an interface circuit associated with the sensor component. A sensor component (e.g., a microphone element or other type of sensor element) can comprise a backplate component and a diaphragm component. The sensor component can be associated with (e.g., interfaced with) a circuit (e.g., an ASIC) that can facilitate enhancing an acoustic overload point associated with the sensor component and enhancing electrostatic discharge protection of the sensor component and other components (e.g., an A-to-D converter, a gain component, a filter component, another ASIC, . . . ) interfaced, directly or indirectly, with the sensor component.

The backplate component of the sensor component can be biased to a low-level voltage associated with a ground. The diaphragm component of the sensor component can be biased to a defined high-voltage associated with a charge pump component, which can supply a desired voltage level (e.g., 12 volts, or higher (or lower) than 12 volts). The diaphragm component can generate a signal based at least in part on movement or vibration of the diaphragm component in relation to the backplate component in response to an input signal (e.g., audio signal or waves, pressure signal or waves, or other type of signal or waves). The interface circuit can comprise a decoupler component that can be associated with the diaphragm component and charge pump component at a node to facilitate decoupling a direct current (DC) level at the node from another DC level at another node associated with the backplate component and the feedback component or filter component. The decoupler component can receive the signal from the diaphragm component and can forward the signal to a feedback component (e.g., to an amplifier component of the feedback component) via, for example, a capacitor component of the decoupler component.

The interface circuit also can comprise the feedback component, which can receive the signal from the diaphragm component, via the decoupler component, and can generate an inverted signal based at least in part on the signal. For instance, the feedback component can comprise the amplifier component, which can act as a buffer, and an inverter amplifier component, wherein the amplifier component can receive the signal, and can provide a buffered signal as an output to the inverter amplifier component. The inverter amplifier component can generate an inverted signal based at least in part on the signal or buffered signal.

In some implementations, the interface circuit also can comprise a filter component that can be associated with (e.g., connected to and situated between) the feedback component and the backplate component. The filter component can desirably filter (e.g., high-pass filter) the inverted signal received from the feedback component (e.g., the inverter amplifier component of the feedback component) to generate a processed (e.g., filtered) inverted signal based at least in part on the inverted signal. The filter component can provide (e.g., transmit, supply) the processed inverted signal to the backplate component. In other implementations, the interface circuit does not include the filter component, wherein the feedback component can provide the inverted signal to the backplate component without the inverted signal being filtered by the filter component.

In certain implementations, the interface circuit can comprise or be associated with (e.g., connected to) an electrostatic discharge protector component that can be associated with the backplate component and the ground or a power supply component. Due in part to the configuration of the system (e.g., comprising the sensor component and interface circuit), wherein the backplate component can be biased to ground or substantially near ground level, it can be feasible to employ the electrostatic discharge protector component with the sensor component (e.g., with the backplate component of the sensor component). The electrostatic discharge protector component can facilitate mitigating (e.g., reducing, eliminating or substantially eliminating) electrostatic discharge associated with the sensor component.

At the same time, by employing the feedback component and feedback circuit, the disclosed subject matter also can enhance the acoustic overload point of the sensor component and associated interface circuit. The signal generated by the sensor component can be spread substantially equally between the diaphragm component and backplate component of the sensor component (e.g., when the gain of the amplifier component and inverter amplifier component is one or approximately one). As a result, half or approximately half of the signal can be present at the node associated with the diaphragm component and half or approximately half of the signal can be present at the node associated with the backplate component. Consequently, the acoustic overload point of the sensor component and associated circuit can be doubled or at least virtually doubled, as compared to, for example, the microphone element and associated circuit of FIG. 7.

These and other aspects of the disclosed subject matter are described with regard to the figures.

Turning to FIG. 1, illustrated is a block diagram of an example system 100 that can enhance the acoustic overload point and electrostatic discharge protection associated with a sensor component and interface circuitry, in accordance with various aspects and embodiments of the disclosed subject matter. The system 100 can be, can comprise, or can be used in connection with a microphone, a pressure sensor, an air flow sensor, a biometric sensor (e.g., a fingerprint sensor), a capacitive sensor, a capacitive antenna, or other types of sensors, components, or devices. In some implementations, the system 100 can be, can comprise, or can be used in connection with a MEMS or semiconductor microphone or sensor.

The system 100 can comprise a sensor component 102 (e.g., sensor element) that can be employed to sense signals (e.g., input signals) or waves. For example, the sensor component 102 can sense audio signals or waves that can be received via an audio port of a microphone. The sensor component 102 can comprise a diaphragm component 104 and a backplate component 106 that can be configured to operate as a variable capacitor. To facilitate forming the variable capacitor of the sensor component 102, the diaphragm component 104 can be configured to have a desirable amount of flexibility to enable the diaphragm component 104 to move or vibrate in response to input signals or waves received by the system 100 (e.g., received by a microphone via the audio port). As the diaphragm component 704 moves or vibrates in response to the input signal (e.g., one or more audio signals), it also can be moving in relation to the backplate component 106, which can vary the capacitance of the variable capacitor, and which can result in the diaphragm component 704 generating a signal (e.g., electrical signal) that can be based at least in part on (e.g., can correspond to) the input signal. The capacitance level of the variable capacitor can be in the range of, for example, 1 pF to 2 pF, or another desired capacitance level.

The system 100 also can include a charge pump component 108 that can provide (e.g., supply) a desired high-level voltage (e.g., 12 volts, or more (or less) than 12 volts). The charge pump component 108 can be employed to facilitate biasing the diaphragm component 104 to a desired high voltage based at least in part on the defined high-level voltage.

The system 100 also can comprise a resistor component 110 that can be associated with (e.g., connected to) the charge pump component 108, wherein the resistor component 110 can be associated with the diaphragm component 104 at the other end of the resistor component 110. The resistor component 110 can have a desired high amount of resistance, for example, on the order of 1 teraohm (e.g., ranging from approximately 1 teraohm to 10 teraohms). In accordance with various implementations, the resistor component 110 can include one or more resistors or other resistive elements, such as, for example, anti-parallel diodes, transistors, or switched capacitors, that can be configured to provide the desired high amount of resistance. The charge pump component 108 can supply the desired high-level voltage to bias the diaphragm component 104 to the desired high voltage through the resistor component 110.

The system 100 can include a decoupler component 112 that can facilitate decoupling the DC voltage level at the node 114 associated with the diaphragm component 104 of the sensor component 102 from the DC voltage level at the node 116 associated with the backplate component 106. The decoupler component 112 can comprise a capacitor component (e.g., one or more capacitors) that can have a desired capacitance value (e.g., 50 pF to 80 pF, or another desired capacitance value) to facilitate the decoupling of the respective DC voltage levels at the respective nodes 114 and 116. The decoupler component 112 also can comprise a resistor component (e.g., one or more resistors or resistive elements) that can be associated with (e.g., connected to) the capacitor component at one end and the ground 118 at the other end.

The system 100 further can comprise a feedback component 120 that can be associated with the decoupler component and can receive the signal generated by the diaphragm component 104 via the decoupler component 112 (e.g., via the capacitor component of the decoupler component 112). The feedback component 120 can generate a desired feedback signal, such as an inverted signal, based at least in part on the signal from the diaphragm component 104. In some implementations, the feedback component 120 can include an amplifier component 122 and an inverter amplifier component 124. The amplifier component 122 can receive the signal via the decoupler component 112. The amplifier component 122 can act as a buffer component or impedance converter, for example, as the output of the capacitor component of the decoupler component 112 can have a relatively high impedance, and it can be desirable to buffer it by using the amplifier component 122. The amplifier component 122 can be a unity gain buffer, for example, wherein the amplifier component 122 can have a gain of one or approximately one. It is to be appreciated and understood that, in other implementations, the amplifier component 122 can have a gain greater than one, if desired.

The amplifier component 122 can provide the signal (e.g., the buffered or processed signal based on the signal from the diaphragm component 104) to an input port of the inverter amplifier component 124. The inverter amplifier component 124 can invert the signal to generate an inverted signal as an output (e.g., from an output port of the inverter amplifier component 124). In certain implementations, the inverter amplifier component 124 can have unity gain (e.g., a gain of one or approximately one). In other implementations, the inverter amplifier component 124 can have a gain that is greater than one, which can increase the voltage level (or power level or amplitude) of the inverted signal, based at least in part on the gain level, as compared to the voltage level (or power level or amplitude) of the inverted signal produced by unity gain.

In some implementations, the inverter amplifier component 124 of the feedback component 120 can be associated with (e.g., connected to) the backplate component 106 of the sensor component 102. The inverted signal generated by the inverter amplifier component 124 can be provided (e.g., supplied, transmitted, fed back) to the backplate component 106.

In other implementations, the system 100 can comprise a filter component 126 that can be associated with (e.g., connected to) the feedback component 120 (e.g., the output port of the inverter amplifier component 124 of the feedback component 120) and can filter or process the inverted signal to generate a filtered or processed inverted signal. For example, the filter component 126 can be a high-pass filter that can comprise a capacitor component that can have a desired capacitance value and can be associated with the backplate component 106, and a resistor component (e.g., connected in parallel with the capacitor component of the filter component 126) that can have a desired resistance value and can be associated with the ground 118. The filter component 126 can facilitate decoupling the DC level, wherein the capacitance of the capacitor component can be a DC decoupling capacitance, as the voltage level at the input port of the filter component 126 typically would not be at ground level, as it typically would be at a voltage level (e.g., approximately 0.8 volts) between the voltage (e.g., approximately 1.6 volts to 3.6 volts) of the power supply component 128 and the voltage (e.g., approximately 0.0 volts) at the ground 118. The resistor component of the filter component 126 can facilitate decoupling the DC level to decouple the ground level of the ground 118 to the backplate component 106 to facilitate enabling the backplate component 106 to have a DC voltage level at ground 118 and an AC voltage level that can be the same as the AC signal appearing at the output port of the inverter amplifier component 124.

When the filter component 126 is not employed, and the inverted signal produced by the inverter amplifier component 124 is directly fed back to the backplate component 106, the backplate component 106 typically can be expected to not quite be at ground level of the ground 118, with the voltage level at the backplate component 106 can be at some point between the voltage level of the power supply component 128 and the ground level of the ground 118. For example, the backplate component 106 may be approximately 0.8 volts or 0.9 volts, instead of at the ground level of the ground 118. As desired, the voltage supplied by the charge pump component 108 can be adjusted (e.g., correspondingly or proportionally increased) to increase the voltage level at the node 114 to compensate for the voltage level associated with the backplate component 106 and the node 116 not being at the ground level of the ground 118.

In certain implementations, the interface circuit of the system 100 can comprise or be associated with (e.g., connected to) an electrostatic discharge (ESD) protector component 130 that can be associated with (e.g., connected to) the backplate component 106 and to the ground 118 or the power supply component 128. The electrostatic discharge protector component 130 can be associated with the node 116, which can be a low impedance node due in part to the inverted signal produced at the output port of the inverter amplifier component 124. Due in part to the configuration of the system 100 (e.g., comprising the sensor component 102 and the interface circuit), wherein the backplate component 106 can be biased to ground 118 or substantially near ground level, it can be feasible to employ the electrostatic discharge protector component 130 with the sensor component 102 (e.g., with the backplate component 106 of the sensor component 102). The electrostatic discharge protector component 130 can facilitate mitigating (e.g., reducing, eliminating, or substantially eliminating) electrostatic discharge to which the sensor component 102 or other components of the system 100 may be subjected, wherein electrostatic discharge potentially can be produced at the audio port associated with the sensor component 102 (e.g., the audio port of a microphone wherein audio signals can be received) or at another part of the system 100.

At the same time, by employing the feedback component 120 and feedback circuit to the backplate component 106, the disclosed subject matter also can enhance (e.g., improve, increase) the acoustic overload point of the sensor component 102 and associated interface circuit of the system 100. By feeding back the inverted signal or processed inverted signal to the backplate component 106, if the amplifier component 122 and the inverter amplifier component 124 each have a gain of one or approximately one, the signal generated by the sensor component 102 can be spread equally or at least substantially equally between the diaphragm component 104 and the backplate component 106 of the sensor component 102. As a result, half or approximately half of the signal can be present at the node 114 associated with the diaphragm component 104 and half or approximately half of the signal can be present at the node 116 associated with the backplate component 106. In this way, the driving capability of the ASIC basically can be increased. This also can allow for a higher signal being processed by the sensor component 102 and the ASIC. In this way, while maintaining the overall sensitivity of the sensor component 102 (e.g., microphone element), the signal present at the diaphragm component 104 can be lower, which can ease the design of the biasing of the input terminal of the ASIC. Also, with this circuit and feedback arrangement, no stack of input bias diodes is needed up to higher signal amplitudes. Further, the feedback arrangement can allow for relatively faster recovery from high acoustic overload situations, which can decrease the sensitivity to light exposure and easier implementation of reset and/or pre-charge of high impedance nodes of the amplifier. Consequently, the acoustic overload point of the sensor component 102 and associated circuit (e.g., ASIC) can be doubled or at least virtually doubled, as compared to, for example, the microphone element and associated circuit of FIG. 7.

Figure 2:
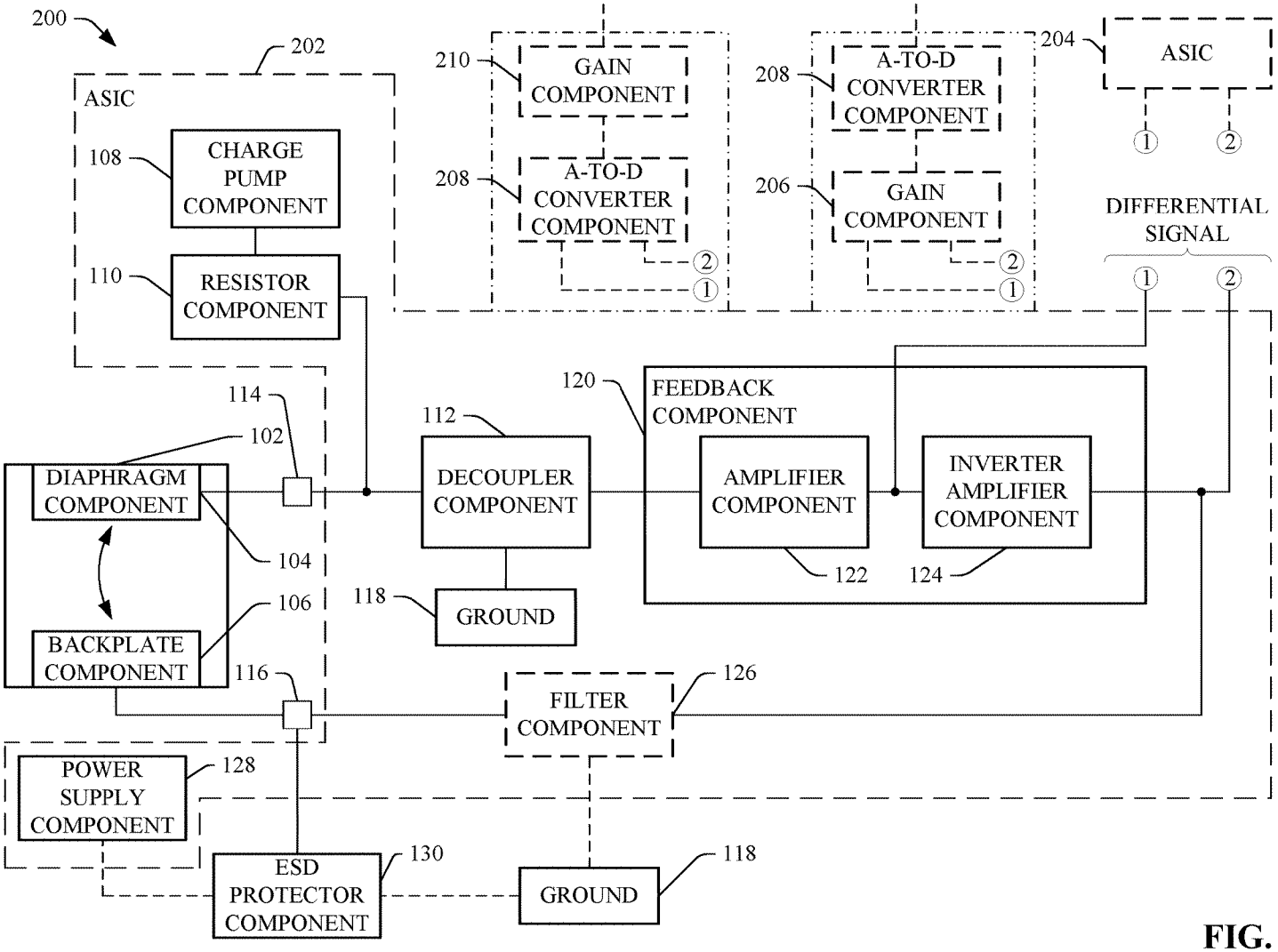
FIG. 2 illustrates a block diagram of an example system comprising a sensor component and associated interface circuit that can facilitate interfacing the sensor component with an application-specific integrated circuit (ASIC), in accordance with various aspects and embodiments of the disclosed subject matter.

Referring briefly to FIG. 2 (along with FIG. 1), FIG. 2 illustrates a block diagram of an example system 200 comprising a sensor component 102 and associated (e.g., interfaced) circuit (e.g., ASIC) that can facilitate interfacing the sensor component with another component(s) (e.g., an A-to-D converter, a gain component, another ASIC, . . . ), in accordance with various aspects and embodiments of the disclosed subject matter. The sensor component 102 can be associated with an ASIC 202, which can comprise the charge pump component 108, the resistor component 110, the decoupler component 112, the feedback component 120, the amplifier component 122, the inverter amplifier component 124, and/or the power supply component 128. In certain implementations, the ASIC 202 can comprise (e.g., optionally can comprise) the filter component 126. In accordance with various embodiments, the ASIC 202 can be associated with (e.g., as depicted) and/or can comprise (e.g., optionally can comprise) the ESD protector component 130.

In some embodiments, with regard to the system 200 being employed with analog devices (e.g., an analog microphone), the ASIC 202 (e.g., the feedback component 120 of the ASIC 202) can supply a differential signal (e.g., a pseudo-differential signal) to pads of another ASIC 204. The differential signal can be an analog signal and can comprise the processed or buffered signal (e.g., signal (1)) generated by the amplifier component 122 and the inverted signal (e.g., signal (2)) generated by the inverter amplifier component 124. The ASIC 204 can perform further desired signal processing on the differential signal. For example, as desired, the ASIC 204 can comprise circuitry that can perform A-to-D conversion, amplification (e.g., via an amplification stage), filtering, and/or other signal processing of the differential signal.

In other embodiments, with regard to the system 200 being employed with digital devices (e.g., a digital microphone), the ASIC 202 can comprise a gain component 206 (e.g., an analog gain component) and/or an A-to-D converter component 208. The differential signal can be supplied to the gain component 206, and the gain component 206 can increase or decrease the gain of the differential signal to generate a gain-adjusted analog signal. The gain-adjusted analog signal can be supplied to the A-to-D converter component 208, which can convert the gain-adjusted analog signal from the gain component 206 to a digital signal. If desired, the digital signal output from the A-to-D converter component 208 can be provided (e.g., supplied) for further processing by another component(s) associated with the A-to-D converter component 208.

In still other embodiments (e.g., alternatively), with regard to the system 200 being employed with digital devices, the ASIC 202 can comprise an A-to-D converter component 208 and/or a gain component 210 (e.g., a digital gain component). The differential signal can be supplied to the input of the A-to-D converter component 208, which can convert the analog differential signal from the feedback component 120 to a digital signal.

In some implementations, if it is desired to increase or decrease the gain of the digital signal, the digital signal generated by the A-to-D converter component 208 can be provided to a gain component 210 to increase or decrease the gain of the digital signal by a desired amount. If desired, the gain-adjusted digital signal output from the gain component 210 can be provided (e.g., supplied) for further processing by another component(s) associated with the gain component 210.

Figure 3:
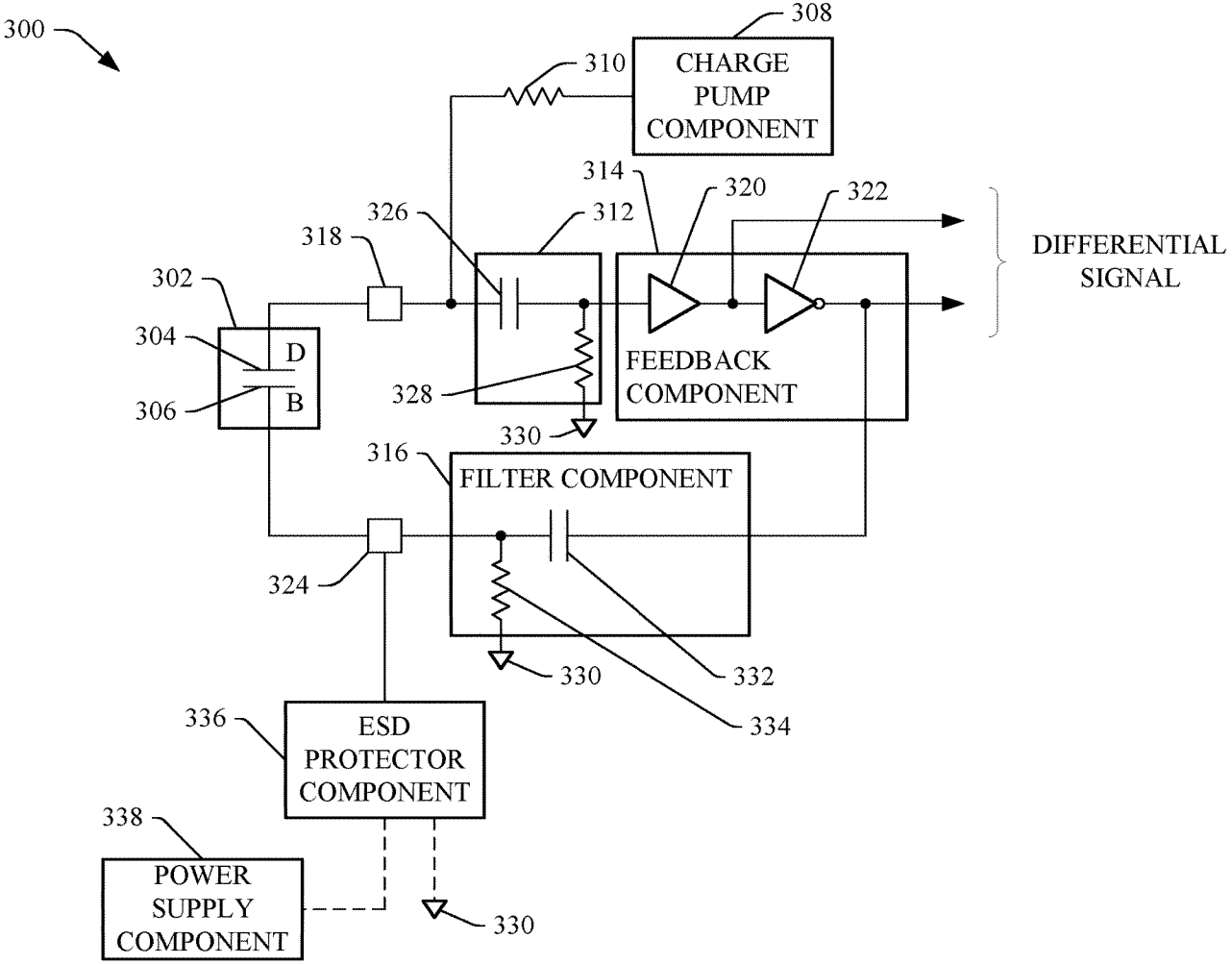
FIG. 3 depicts a diagram of an example system that can employ a filter associated with a backplate component of a sensor component, and can enhance the acoustic overload point and electrostatic discharge protection associated with the sensor component and associated interface circuit, in accordance with various aspects and embodiments of the disclosed subject matter.

FIG. 3 depicts a diagram of an example system 300 can employ a filter associated with a backplate component of a sensor component, and can enhance the acoustic overload point and electrostatic discharge protection associated with the sensor component and associated interface circuit, in accordance with various aspects and embodiments of the disclosed subject matter. The system 300 can comprise a sensor component 302, including a diaphragm component 304 and a backplate component 306, a charge pump component 308, a resistor component 310, a decoupler component 312, a feedback component 314, and a filter component 316 that, respectively, can be the same as or similar to, and/or can comprise the same or similar features or functionalities as, respective components (e.g., respectively named components), as more fully disclosed herein.

The diaphragm component 304 and backplate component 306 can be configured to form a variable capacitor. The diaphragm component 304 can be configured to be desirably (e.g., sufficiently) flexible to enable the diaphragm component 304 to vibrate or move in response to an input signal (e.g., audio signal or other signal) received or sensed by the sensor component 302. The capacitance of the variable capacitor can vary based at least in part on (e.g., as a function of) the varying of the distance between the diaphragm component 304 and the backplate component 306 as the diaphragm component 304 moves or vibrates in relation with the backplate component 306 in response to the input signal. The capacitance value of the variable capacitor can range, for example, from 1 pF to 2 pF, or can have another desired capacitance range. The diaphragm component 304 can generate a signal, which can correspond to the input signal (e.g., can represent the input signal in an electrical form), based at least in part on the capacitance level of the variable capacitor formed by the diaphragm component 304 and backplate component 306. The signal produced by the diaphragm component 304 can be supplied to the decoupler component 312.

The charge pump component 308 can be associated with (e.g., connected to) the resistor component 310 at one end of the resistor component 310, wherein the other end of the resistor component 310 can be associated with a node 318, and with the diaphragm component 304 and decoupler component 312, which also can be associated with the node 318. The resistor component 310 can have a desired high amount of resistance, for example, on the order of 1 teraohm (e.g., ranging from approximately 1 teraohm to 10 teraohms). In accordance with various implementations, the resistor component 310 can include one or more resistors, anti-parallel diodes, transistors, or switched capacitors that can be configured to provide the desired high amount of resistance. The charge pump component 308 can supply the desired high-level voltage to bias the diaphragm component 304 to the desired high voltage through the resistor component 310.

The output of the decoupler component 312 can be associated with the input of the feedback component 314. The feedback component 314 can comprise an amplifier component 320, which can receive, at its input port, a signal generated by the diaphragm component 304 via the decoupler component 312. The feedback component 314 also can comprise an inverter amplifier component 322, wherein the buffered or processed signal generated by the amplifier component 320 can be supplied to the input port of the inverter amplifier component 322. The inverter amplifier component 322 can generate an inverted signal, which can be provided as an output from the output port of the inverter amplifier component 322. The inverted signal can be supplied to the input of the filter component 316, which can be associated with the output port of the inverter amplifier component 322. The output of the filter component 316 can be associated with the backplate component 306 and node 324.

With further regard to the decoupler component 312, the decoupler component 312 can comprise a capacitor component 326 and a resistor component 328 associated with (e.g., connected to) the capacitor component 326 on one end and the ground 330 at the other end of the resistor component 328. The capacitor component 326 can have a capacitance of, for example, 5 pF, or another desired capacitance value. The resistance level of the resistor component 328 can be on the order of a teraohm or tenths of teraohms. The resistor component 328 can comprise one or more resistors, anti-parallel diodes, transistors, or switched capacitors that can be configured to provide the desired resistance level.

With further regard to the filter component 316, the filter component 316 can comprise a capacitor component 332 and a resistor component 334 associated with (e.g., connected to) the capacitor component 332 on one end and the ground 330 at the other end of the resistor component 334. The capacitor component 332 can have a desired capacitance value, and the resistor component 334 can have a desired resistance level. The resistor component 334 can comprise one or more resistors, anti-parallel diodes, transistors, or switched capacitors that can be configured to provide the desired resistance level. The backplate component 306 can be biased to the ground 330 via the resistor component 334.

The system 300 also can comprise an electrostatic discharge protector component 336 that can be associated with (e.g., connected to) the backplate component 306 and to the ground 330 or the power supply component 338. The electrostatic discharge protector component 336 also can be associated with the node 324, which can be a low impedance node due in part to the inverted signal produced at the output port of the inverter amplifier component 322. Due in part to the configuration of the system 300, wherein the backplate component 306 can be biased to ground 330 or substantially near ground level, it can be feasible to employ the electrostatic discharge protector component 336 with the sensor component 302 (e.g., with the backplate component 306 of the sensor component 302). The electrostatic discharge protector component 336 can facilitate mitigating (e.g., reducing, eliminating, or substantially eliminating) electrostatic discharge to which the sensor component 302 or other components of the system 300 may be subjected.

At the same time, by employing the feedback component 314 and feedback circuit to the backplate component 306 via the filter component 316, and producing a differential signal (e.g., pseudo-differential signal) based at least in part on the signal generated by the sensor component 302, the disclosed subject matter also can enhance (e.g., improve, increase) the acoustic overload point of the sensor component 302 and associated circuit (e.g., ASIC) of the system 300, as more fully described herein. For example, the acoustic overload point of the sensor component 302 and associated circuit of the system 300 can be doubled or at least virtually doubled, as compared to the microphone element and associated circuit of FIG. 7.

Figure 4:
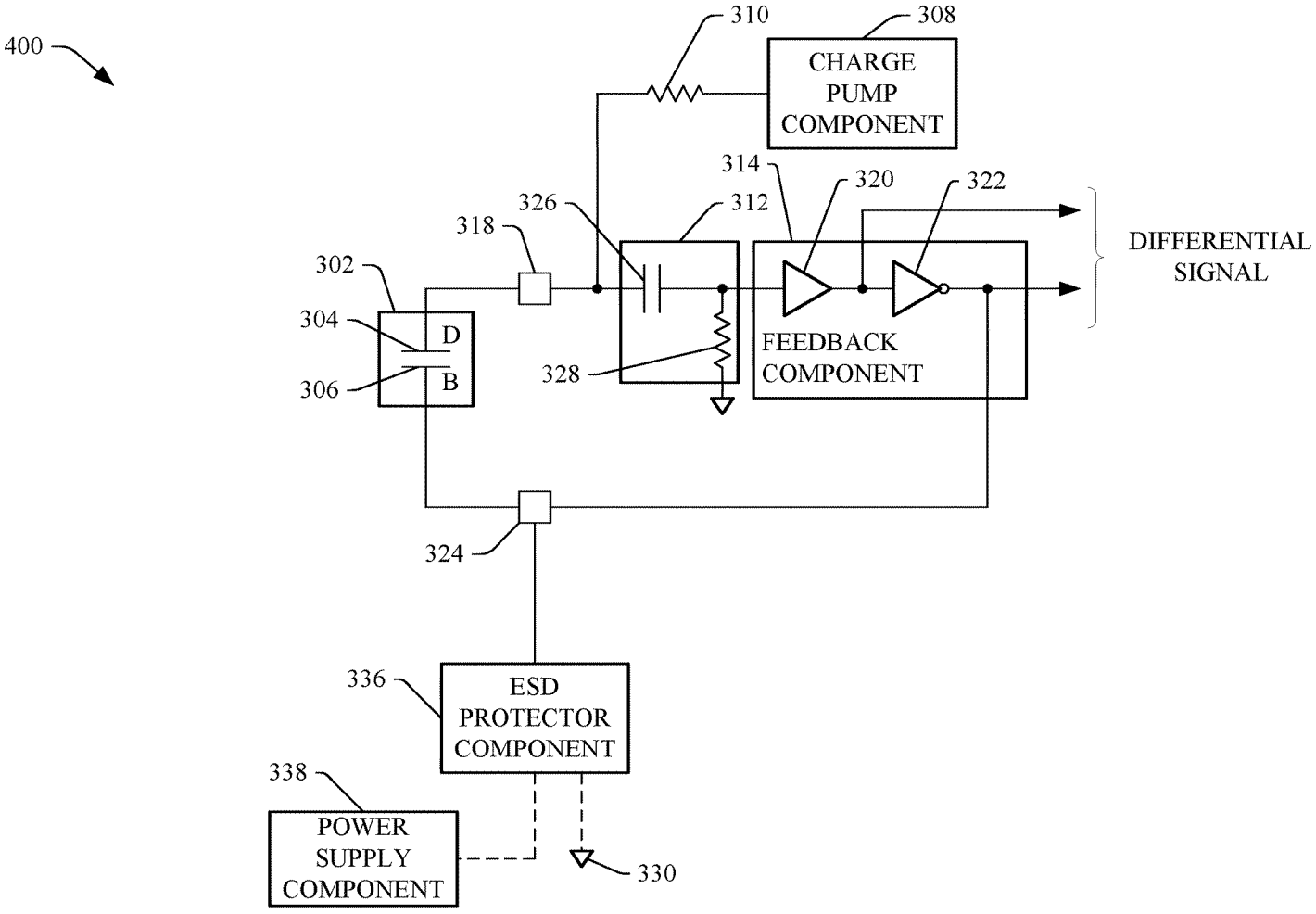
FIG. 4 presents a diagram of an example system that can enhance the acoustic overload point and electrostatic discharge protection associated with a sensor component and associated interface circuit, in accordance with various aspects and embodiments of the disclosed subject matter.

FIG. 4 presents a diagram of an example system 400 that can enhance the acoustic overload point and electrostatic discharge protection associated with a sensor component and associated interface circuit, in accordance with various aspects and embodiments of the disclosed subject matter. The system 400 can be substantially the same as the system 300 of FIG. 3, except that the system 400 does not include the filter component 316 between the output of the feedback component 314 and the backplate component 306. The system 400 can comprise the sensor component 302, including the diaphragm component 304 and backplate component 306, the charge pump component 308, the resistor component 310, the decoupler component 312, the feedback component 314, node 318, amplifier component 320, inverter amplifier component 322, node 324, the capacitor component 326 (of the decoupler component 312), the resistor component 328 (of the decoupler component 312), the ground 330, the electrostatic discharge protector component 336, and the power supply component 338. These respective components of the system 400 can be the same as or similar to, and/or can comprise the same or similar features or functionalities as, respective components (e.g., respectively named components), as more fully disclosed herein.

Since, in the system 400, no filter component is employed in connection with the backplate component 306, the bias voltage level associated with the backplate component 306 typically will not be at ground level, although it can still be a relatively low voltage level (e.g., as compared to the high voltage level produced by the charge pump component 308). The bias voltage level associated with the backplate component 306 can be a voltage level that is somewhere between 0 volts (e.g., ground level) and the voltage produced by the power supply component 338, wherein the voltage produced by the power supply component 338 can be between 1.6 volts and 3.6 volts, such as, e.g., approximately 1.8 volts. The bias voltage level associated with the backplate component 306 may be approximately 0.8 volts or 0.9 volts, for example. If the charge pump component 308 is generating a high-level voltage of 12 volts, the voltage across the sensor component 302 can be 12 volts-0.8 volts (or 0.9 volts). In some implementations, as desired, the voltage generated by the charge pump component 308 can be adjusted to increase (e.g., correspondingly or proportionally increase) the voltage (e.g., to 12.8 volts (or 12.9 volts)) to compensate for the voltage associated with the backplate component 306 being approximately 0.8 volts or 0.9 volts.

The electrostatic discharge protector component 336 can facilitate mitigating (e.g., reducing, eliminating, or substantially eliminating) electrostatic discharge to which the sensor component 302 or other components of the system 400 may be subjected. At the same time, by employing the feedback component 314 and feedback circuit to the backplate component 306, and producing a differential signal (e.g., pseudo-differential signal) based at least in part on the signal generated by the sensor component 302, the disclosed subject matter also can enhance (e.g., improve, increase) the acoustic overload point of the sensor component 302 and associated interface circuit of the system 400, as more fully described herein. As an example, the acoustic overload point of the sensor component 302 and associated circuit (e.g., ASIC) of the system 400 can be doubled or at least virtually doubled, as compared to the microphone element and associated circuit of FIG. 7.

In accordance with various embodiments of the disclosed subject matter, components (e.g., sensor component, feedback component, decoupler component, filter component, . . . ) of a system can be situated or implemented on a single integrated circuit (IC) die or chip. An IC chip can be a complementary metal-oxide-semiconductor (CMOS) chip, for example. In accordance with various other embodiments, the components of the system can be implemented on an ASIC chip. In accordance with still other embodiments, the components of the system can be situated or implemented on multiple IC dies or chips.

The aforementioned devices and/or systems have been described with respect to interaction between several components. It should be appreciated that such systems and components can include those components or sub-components specified therein, some of the specified components or sub-components, and/or additional components. Sub-components could also be implemented as components coupled to and/or communicatively coupled to other components rather than included within parent components. Further yet, one or more components and/or sub-components may be combined into a single component providing aggregate functionality. The components may also interact with one or more other components not specifically described herein for the sake of brevity, but known by those of skill in the art.

Figure 5:
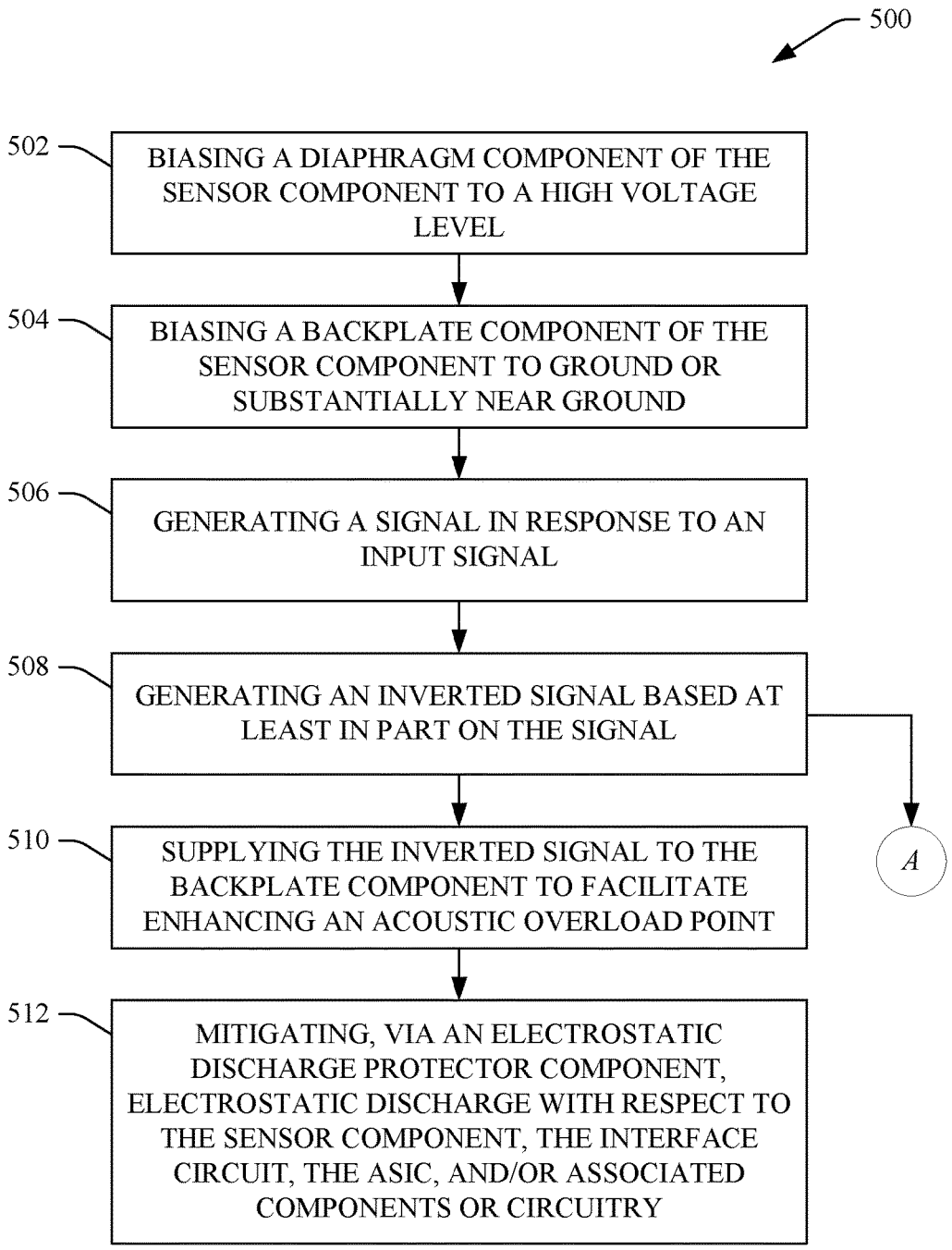
FIG. 5 illustrates a flow diagram of an example method that can facilitate enhancing an acoustic overload point and mitigating electrostatic discharge associated with a sensor component, in accordance with various aspects and embodiments of the disclosed subject matter.
Figure 6:
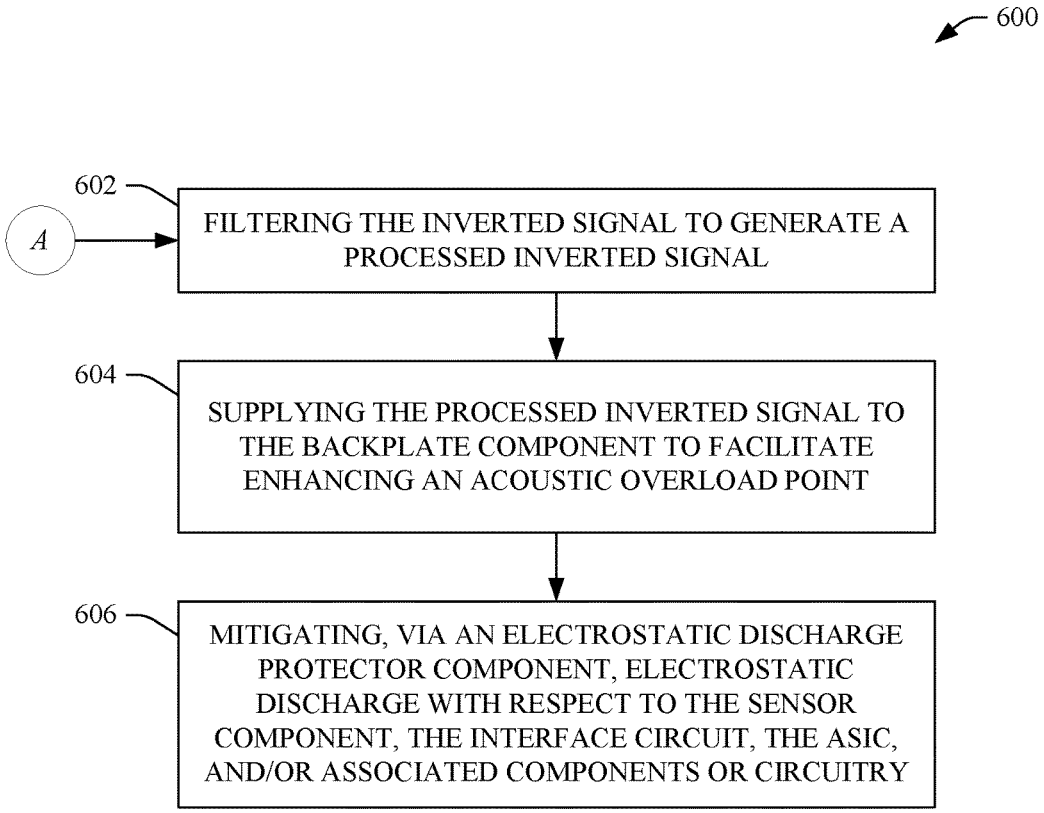
FIG. 6 depicts a flow diagram of an example method that can employ a filter component in connection with facilitating enhancement of an acoustic overload point and mitigation of electrostatic discharge associated with a sensor component, in accordance with various aspects and embodiments of the disclosed subject matter.

FIGS. 5-6 illustrate methods and/or flow diagrams in accordance with the disclosed subject matter. For simplicity of explanation, the methods are depicted and described as a series of acts. It is to be understood and appreciated that the subject disclosure is not limited by the acts illustrated and/or by the order of acts, for example acts can occur in various orders and/or concurrently, and with other acts not presented and described herein. Furthermore, not all illustrated acts may be required to implement the methods in accordance with the disclosed subject matter.

Referring to FIG. 5, illustrated is a flow diagram of an example method 500 that can facilitate enhancing an acoustic overload point and mitigating electrostatic discharge associated with a sensor component, in accordance with various aspects and embodiments of the disclosed subject matter. The method 500 can be implemented by a system or device comprising the sensor component, a feedback component, and an electrostatic discharge protector component, for example.

At 502, a diaphragm component of the sensor component can be biased to a high voltage level. The diaphragm component can be associated with a charge pump component via a resistor component having a desired resistance value. The charge pump component can generate a desired high-level voltage and can supply the desired high-level voltage to the diaphragm component through the resistor component to bias the diaphragm component to the high voltage level.

At 504, a backplate component of the sensor component can be biased to ground or substantially near ground. The backplate component can be associated with the ground directly or indirectly to facilitate biasing the backplate component to ground or substantially near ground (e.g., approximately ground level (approximately 0 volts) when a filter component is employed in connection with the backplate component; approximately 0.9 volts or less when no filter component is employed in connection with the backplate component).

At 506, a signal can be generated in response to an input signal. The diaphragm component can generate the signal based at least in part on the input signal (e.g., audio signal or other type of signal), wherein the generated signal can correspond to or represent (e.g., be a representation in electrical form of) the generated signal.

At 508, an inverted signal can be generated based at least in part on the signal. The feedback component can generate the inverted signal based at least in part on the signal generated by the diaphragm component. The feedback component can comprise an amplifier component (e.g., a buffer component) and an inverter amplifier component. The amplifier component can receive the signal (e.g., via a decoupler component) and can buffer or process the signal for further processing by the inverter amplifier component.

The inverter amplifier component can invert the signal (e.g., the buffered or processed signal) to generate the inverted signal.

In some implementations, the method 500 can proceed to reference point A, wherein the inverted signal can be filtered to generate a filtered or processed inverted signal, which can be provided to the backplate component to facilitate enhancing the acoustic overload point of the sensor component and associated circuit (e.g., ASIC). In other implementations, the method 500 can continue from reference numeral 508 to reference numeral 510.

At 510, the inverted signal can be supplied to the backplate component to facilitate enhancing an acoustic overload point. In some implementations, the inverted signal generated by the inverted amplifier component can be supplied to the backplate component to facilitate enhancing (e.g., improving, increasing) the acoustic overload point of the sensor component and associated circuit (e.g., ASIC), which can be employed to facilitate interfacing the sensor component with an A-to-D converter component, a gain component, another filter, another ASIC, or other signal processing circuitry or components.

At 512, electrostatic discharge can be mitigated, via an electrostatic discharge protector component, with respect to the sensor component, the associated circuit (e.g., ASIC), another signal processing component, and/or associated components or circuitry. The electrostatic discharge protector component can be associated with the backplate component and/or the associated circuit to facilitate mitigating (e.g., reducing, eliminating, and/or substantially eliminating) electrostatic discharge with respect to the sensor component, the associated circuit, the other signal processing component(s) (e.g., an A-to-D converter, a gain component, a filter component, or another ASIC that performs signal processing or conditioning), and/or associated components or circuitry. Due in part to the backplate component being biased to ground or substantially near ground, it can be suitable to associate the electrostatic discharge protector component with the backplate component and/or the interface circuit to facilitate mitigating the electrostatic discharge with respect to the sensor component, the interface circuit, the ASIC, and/or associated components or circuitry.

Turning to FIG. 6, depicted is a flow diagram of an example method 600 that can employ a filter component in connection with facilitating enhancement of an acoustic overload point and mitigation of electrostatic discharge associated with a sensor component, in accordance with various aspects and embodiments of the disclosed subject matter. The method 600 can be implemented by a system or device comprising the sensor component, a feedback component, the filter component, and an electrostatic discharge protector component, for example. In some implementations, the method 600 can proceed from reference point A of the method 500 of FIG. 5.

At 602, the inverted signal can be filtered to generate a processed inverted signal. The inverted signal produced by the feedback component can be supplied to the filter component. The filter component can filter the inverted signal to generate the processed or filtered inverted signal. In some implementations, the filter component can comprise a high-pass filter. A resistor component of the filter component can facilitate biasing the backplate component to the ground, wherein the inverted signal (or the processed or filtered signal generated by the filter component based at least in part on the inverted signal) can be supplied to the backplate component via a capacitor component of the filter component.

At 604, the processed inverted signal can be supplied to the backplate component to facilitate enhancing an acoustic overload point. In some implementations, the processed inverted signal generated by the filter component can be supplied to the backplate component to facilitate enhancing (e.g., improving, increasing) the acoustic overload point of the sensor component and associated circuit (e.g., ASIC).

At 606, electrostatic discharge can be mitigated, via an electrostatic discharge protector component, with respect to the sensor component, the interface circuit, the ASIC, and/or associated components or circuitry. The electrostatic discharge protector component can be associated with the backplate component and/or interface circuit to facilitate mitigating (e.g., reducing, eliminating, and/or substantially eliminating) electrostatic discharge with respect to the sensor component, the associated circuit (e.g., the ASIC), and/or associated components or circuitry. Due in part to the backplate component being biased to ground or at least substantially near ground, it can be suitable to associate the electrostatic discharge protector component with the backplate component and/or the interface circuit to facilitate mitigating the electrostatic discharge with respect to the sensor component, the associated circuit, and/or other associated components or circuitry.

It is to be appreciated and understood that components (e.g., sensor component, diaphragm component, backplate component, feedback component, decoupler component, charge pump component, filter component, power supply component, electrostatic discharge protector component, . . . ), as described with regard to a particular device, system, or method, can include the same or similar functionality as respective components (e.g., respectively named components or similarly named components) as described with regard to other devices, systems, or methods disclosed herein.

Although the description has been provided with respect to particular embodiments thereof, these particular embodiments are merely illustrative and not restrictive.

While particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As used in this application, the terms "component," "system," "interface," and the like, can refer to and/or can include a computer-related entity or an entity related to an operational machine with one or more specific functionalities. The entities disclosed herein can be either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

In another example, respective components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

What has been described above includes examples of aspects of the disclosed subject matter. It is, of course, not possible to describe every conceivable combination of components or methods for purposes of describing the disclosed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has," or "having," or variations thereof, are used in either the detailed description or the claims, such terms are intended to be inclusive in a manner similar to the term "comprising" as "comprising" is interpreted when employed as a transitional word in a claim.

What is claimed is:

1. A system, comprising:

a sensor component that senses an input signal, wherein the sensor component comprises:

a backplate component, and a diaphragm component that generates a signal based at least in part on movement of the diaphragm component in relation to the backplate component in response to the input signal, wherein the backplate component is biased to a defined low-level voltage associated with a ground; and a feedback component that receives the signal from the diaphragm component and generates an inverted signal based at least in part on the signal, wherein the feedback component provides the inverted signal as an output, and wherein the inverted signal or a processed inverted signal that is based at least in part on the inverted signal is transmitted to the backplate component.

2. The system of claim 1, wherein the sensor component comprises a Microelectromechanical Systems (MEMS) sensor.

3. The system of claim 1, further comprising a charge pump component that generates a defined high-level voltage, wherein the diaphragm component is biased to a defined voltage level based at least in part on the defined high-level voltage.

4. The system of claim 1, further comprising a filter component that receives the inverted signal from the feedback component and filters the inverted signal to generate the processed inverted signal, wherein the filter component transmits the processed inverted signal to the backplate component.

5. The system of claim 4, wherein the filter component comprises a high-pass filter that has a defined threshold filter frequency.

6. The system of claim 4, wherein the filter component facilitates a direct current connection between the backplate component and the ground through a resistor component of the filter component that is associated with the backplate component and the ground, and facilitates an alternating current connection between the feedback component and the backplate component via a capacitor component of the filter component.

7. The system of claim 1, wherein the feedback component further comprises:

a buffer component that buffers the signal to generate a buffer signal; and an inverter amplifier component that receives the buffer signal and generates the inverted signal based at least in part on the buffer signal.

8. The system of claim 7, wherein the inverter amplifier component has a gain level of approximately one or higher than one.

9. The system of claim 7, wherein the buffer component comprises an amplifier that has a gain level of approximately one.

10. The system of claim 7, wherein the feedback component is interfaced with at least one of an integrated circuit, an analog-to-digital converter component, or a gain stage component, wherein the feedback component generates a differential signal based at least in part on the buffer signal and the inverted signal, wherein the feedback component transmits the differential signal to at least one of the integrated circuit, the analog-to-digital converter component, or the gain stage component.

11. The system of claim 7, further comprising a decoupler component that is associated with the diaphragm component and a charge pump component via a first node and associated with an input port of the buffer component at an output port of the decoupler component, wherein the decoupler component decouples a first direct current level at the first node from a second direct current level at a second node that is situated between the feedback component and the backplate component, and wherein the decoupler component receives the signal from the diaphragm component and transmits the signal to the input port of the buffer component.

12. The system of claim 1, further comprising an electrostatic discharge protector component that is associated with the backplate component and a wound or a power supply component, wherein the electrostatic discharge protector component facilitates mitigating electrostatic discharge associated with the sensor component.

13. The system of claim 12, wherein the feedback component facilitates enhancing an acoustic overload point associated with the sensor component, and wherein the electrostatic discharge protector component and the feedback component facilitate mitigating electrostatic discharge associated with the sensor component.

14. The system of claim 1, wherein the sensor component comprises at least one of an audio sensor, a pressure sensor, an air flow sensor, a capacitive sensor, a biometric sensor, or an antenna.

15. A method, comprising:

generating, by a first plate component, a signal as a function of movement of the first plate component in relation to a second plate component in response to an input signal, wherein the second plate component is biased to a defined low voltage level associated with a ground;

generating, by feedback circuitry, an inverted signal as a function of the signal; and supplying, by the feedback circuitry or a filter component, the inverted signal or a processed inverted signal that is based at least in part on the inverted signal to the second plate component.

16. The method of claim 15, further comprising:

generating a defined high voltage level; and supplying the defined high voltage level to the first plate component to facilitate biasing the first plate component to a defined voltage level as a function of the defined high voltage level.

17. The method of claim 15, further comprising:

filtering the inverted signal to generate the processed inverted signal, wherein the processed inverted signal is supplied to the second plate component.

18. The method of claim 15, further comprising:

generating a differential signal based at least in part on the signal and the inverted signal; and supplying the differential signal to at least one of an integrated circuit, an analog-to-digital converter, or a gain component.

19. The method of claim 15, further comprising:

decoupling a first current level associated with a first node that is associated with the first plate component from a second current level associated with a second node that is associated with the second plate component.

20. The method of claim 15, further comprising:

an electrostatic discharge protector component that is associated with the first plate component and a ground, wherein the electrostatic discharge protector component facilitates mitigating electrostatic discharge associated with the sensor component.

* * * * *